US007162149B2

(12) United States Patent
Evans

(10) Patent No.: US 7,162,149 B2
(45) Date of Patent: Jan. 9, 2007

(54) GASEOUS FLUID GENERATION SYSTEM

(76) Inventor: Robert Evans, 45 McGregory Rd., Sturbridge, MA (US) 01566

( * ) Notice: Subject to any disclaimer, the term of this patent is extended or adjusted under 35 U.S.C. 154(b) by 0 days.

(21) Appl. No.: 10/832,990

(22) Filed: Apr. 26, 2004

(65) Prior Publication Data

US 2005/0249485 A1 Nov. 10, 2005

(51) Int. Cl.
*F24H 1/20* (2006.01)

(52) U.S. Cl. ..... 392/447; 392/386; 392/401

(58) Field of Classification Search ..... 392/465, 392/466, 386, 394–403
See application file for complete search history.

(56) References Cited

U.S. PATENT DOCUMENTS 2,727,979 A * 12/1955 Altosaar ..... 392/448
6,456,785 B1 9/2002 Evans
6,911,626 B1 * 6/2005 Shozo ..... 219/401

OTHER PUBLICATIONS

CES-B Vertical Steam Boiler [online]. Retrieved from the Internet, <URL: http://www.chromalox.com/products/productinfo/en/pdf/cesb.pdf>.
Electro Steam Generators [online]. Retrieved from the Internet, <URL: http://www.electrosteam.com/ultra_pure.htm>.

* cited by examiner

*Primary Examiner*—Thor S. Campbell
(74) *Attorney, Agent, or Firm*—Chapin IP Law, LLC; David W. Rouille, Esq.; Barry W. Chapin, Esq.

(57) ABSTRACT

The present invention relates to a gaseous fluid generation system, a columnar heating device, and a method for generating a gaseous fluid. In one embodiment, the gaseous fluid generation system includes a reservoir-less columnar vessel having a liquid fluid inlet and a gaseous fluid outlet and at least one resistive heating element contained within the columnar vessel. The columnar vessel is oriented such that the gaseous fluid outlet is elevated with respect to the liquid fluid inlet. In one embodiment, the gaseous fluid generation system includes at least one resistive heating element having a power density selected to heat a fluid selected from the group consisting of a liquid fluid, a saturated gaseous fluid and a superheated gaseous fluid. In one particular embodiment, resistive heating elements of the columnar vessel have a power density selected to heat both a liquid fluid and a gaseous fluid.

26 Claims, 3 Drawing Sheets

GASEOUS FLUID GENERATION SYSTEM

BACKGROUND OF THE INVENTION

Typical existing electric powered steam generating systems and boilers heat water using electric resistance elements arranged inside a holding reservoir (e.g., a tank or pressure vessel). The reservoir contains water which usually is heated via submerged electric tubular heaters located in the reservoir. These heaters usually operate in a static environment by raising a controlled quantity of water to a prescribed temperature, then releasing that water as required in the form of saturated steam. When steam is required in a typical existing steam generator, water moves from the holding reservoir through a throttle valve, converting the liquid into a saturated steam.

The reservoir typically has a high and low level switch to control water height in the reservoir which introduces ambient temperature water to the reservoir as necessary. When mixed with the water already in the reservoir, this water can lower the temperature of the reservoir water to a temperature lower than that needed to produce operational steam, thus requiring recuperative heating time before steam can be once again generated.

Existing electric powered steam generating systems and boilers can be operationally inefficient. For example, existing electric powered steam generating systems can possess a large thermal mass that must be overcome at start-up. As a result, the amount of time required to reach operating temperature at start-up can be prolonged. In some instances, existing electric powered steam generating systems can require 10 to 15 minutes or more of start-up time from a cold start before they can produce high quality steam.

Existing electric powered steam generating systems can also require continuous supplies of energy to offset thermal losses through the piping network supplying the system and through the insulating layers that can surround holding reservoirs. For example, existing electric powered steam generating systems can require continuous sporadic activation of heating elements, e.g., reservoir heating elements, to maintain water temperature in attempts to avoid re-initiating the start-up process.

SUMMARY OF THE INVENTION

A need exists for a gaseous fluid generation system and a method for generating a gaseous fluid that overcome or minimize the above-referenced problems.

The present invention relates to a gaseous fluid generation system, a columnar heating device, and a method for generating a gaseous fluid. In one embodiment, the gaseous fluid generation system includes a reservoir-less columnar vessel having a liquid fluid inlet and a gaseous fluid outlet and at least one resistive heating element contained within the columnar vessel. The columnar vessel is oriented such that the gaseous fluid outlet is elevated with respect to the liquid fluid inlet. In one embodiment, the gaseous fluid generation system includes at least one resistive heating element having a power density selected to heat a fluid selected from the group consisting of a liquid fluid, a saturated gaseous fluid and a superheated gaseous fluid. In one particular embodiment, resistive heating elements of the columnar vessel have a power density selected to heat both a liquid fluid and a gaseous fluid.

The present invention also includes a columnar heating device having a reservoir-less columnar vessel having a liquid fluid inlet and a gaseous fluid outlet; and at least one resistive heating element contained within the columnar vessel, wherein the resistive heating element has a power density selected to heat a liquid fluid and a gaseous fluid.

A method for generating a gaseous fluid includes the step of directing a liquid fluid into a reservoir-less columnar vessel having a liquid fluid inlet and a gaseous fluid outlet and oriented such that the gaseous fluid outlet is elevated with respect to the liquid fluid inlet and also having at least one resistive heating element contained within the columnar vessel. The method also includes the step of transferring energy provided through the resistive heating element to the liquid fluid to effect a phase transition, thereby producing a gaseous fluid from the liquid fluid prior to exiting the columnar vessel.

Practice of the present invention can allow cost efficient, convenient generation of gaseous fluids. The gaseous fluid generation system and method for generating a gaseous fluid described herein can be useful for producing gaseous fluids, e.g., steam, on-site and on-demand. In one embodiment, the present invention can be used to produce either saturated or superheated gaseous fluids using the same apparatus.

Practice of the present invention does not require a holding reservoir such as those typically present in existing electric powered steam generation systems. Embodiments of the gaseous fluid generation system of the present invention can operate without a holding reservoir such as a heated tank as the present system can vaporize liquid fluids, e.g., liquids, water, aqueous solutions, and slurries, directly within a reservoir-less columnar vessel. In practicing the present invention, liquid fluid, saturated gaseous fluid and superheated gaseous fluid can occupy a shared column of ascending temperature with respect to column height, in contrast to typical existing steam generators which require the water to be held in a holding reservoir in its liquid phase at elevated temperature and/or pressure, e.g., above the boiling point at ambient pressure.

Existing electric powered steam generation devices typically contain heaters located at or near the bottom of the reservoir to help provide for total heater liquid immersion during operation. The total immersion heaters, operating at high power density, can burn out upon losing full immersion due to the low heat capacity of saturated water vapor. In contrast, the present invention includes the use of resistive heating elements that have power densities selected to heat liquid fluids and gaseous fluids. In one embodiment, resistive heating elements having power densities selected to heat both liquid fluids and gaseous fluids are contained within the columnar vessel. Thus, the columnar vessel can contain at least one resistive heating element that can operate without overheating in at least two distinctive states of the fluid in the column, i.e., liquid fluid and gaseous fluid.

Since the present gaseous fluid generation system does not require a holding reservoir, the system does not suffer from thermal mass cold start-up problems of existing steam generation systems. As a result, the present systems and methods do not require a lengthy perfunctory time delay before producing operational gaseous fluid product (e.g., steam) such as the time delay required in many existing steam generation systems. In one embodiment, the present invention can be used to produce an operational gaseous fluid from liquid fluid (e.g., ambient temperature liquid fluid) in less than about 10 minutes. For example, in some embodiments, the present invention can be used to produce an operational gaseous fluid from liquid fluid (e.g., ambient temperature liquid fluid) in about 1 to about 2 minutes.

In addition, because of its design for continuous operation, the present gaseous fluid generation system does not require recuperative time during operation after addition of liquid fluid before gaseous fluids can be generated. Existing steam generation devices can require recuperative time during operation after addition of feed water. In contrast, the liquid fluid continually entering the columnar vessel of the present gaseous fluid generation system experiences a phase transition into a gaseous fluid by energy supplied by at least one resistive heating element prior to exiting the columnar vessel. Liquid fluid introduced to the columnar vessel can be continuously heated and a phase transition can be continuously induced to produce a continuous flow of gaseous fluid from the vessel. The present gaseous fluid generation system can dispose of recuperative time by converting a liquid fluid to gaseous fluid in the time it takes to flow through the columnar vessel.

Unlike typical existing steam generators, the present gaseous fluid generation system does not require additional work to be performed on a heated liquid fluid (e.g., via a throttle valve) to form the gaseous fluid. Using the methods and systems described herein, a gaseous fluid can be generated from a liquid fluid by heating the liquid fluid and effecting a phase transition to the gaseous state within a single columnar vessel. In addition, using the methods and systems described herein, the gaseous fluid can be also be superheated in the same columnar vessel.

The present gaseous fluid generation system does not require large and space constraining holding reservoirs that are typically required by existing steam generation devices. The present gaseous fluid generation system can be compactly positioned in proximity to gaseous fluid applications. For instance, in one embodiment, the present gaseous fluid generation system occupies only a length of delivery piping to the gaseous fluid application. The present gaseous fluid generation system can be integrated into larger commercial systems or can be used as a stand alone gaseous fluid generator.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The present invention relates to a gaseous fluid generation system, a columnar heating device, and a method for generating a gaseous fluid. In one embodiment, the gaseous fluid generation system includes: (a) a reservoir-less columnar vessel having a liquid fluid inlet and a gaseous fluid outlet, oriented such that the gaseous fluid outlet is elevated with respect to the liquid fluid inlet; and (b) at least one resistive heating element contained within the columnar vessel.

Figure 1B:
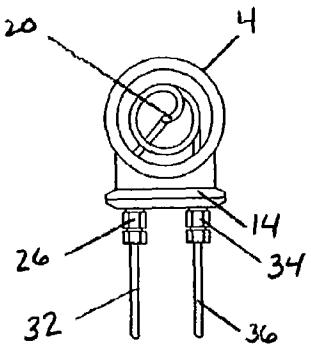
FIG. 1B is a view along line 2—2 of the columnar heating device illustrated in FIG. 1A.
Figure 1A:
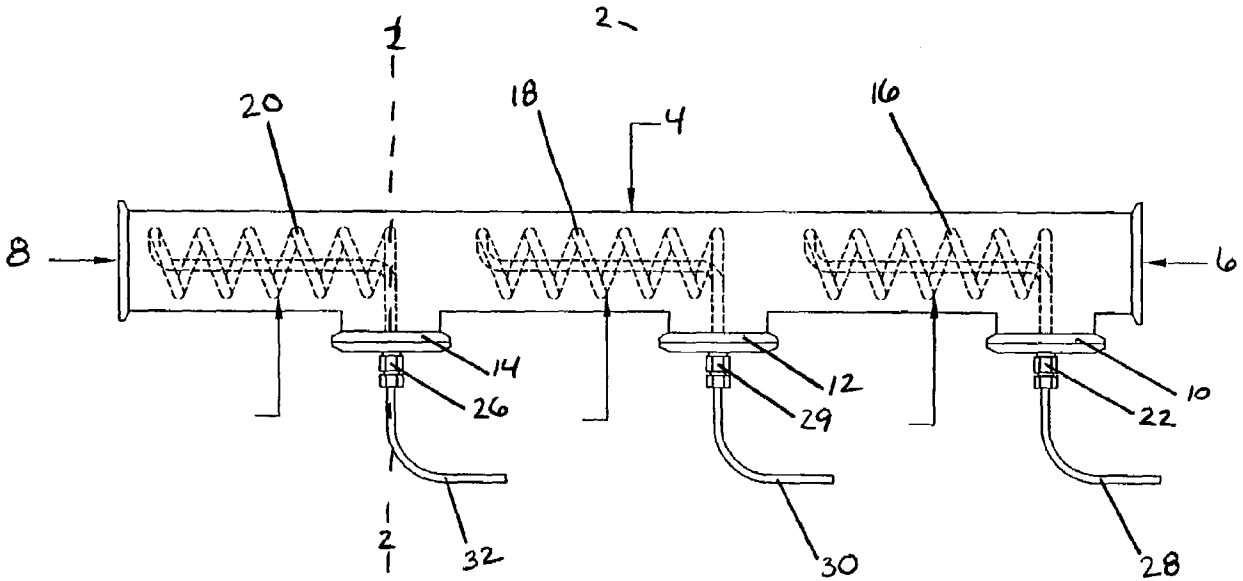
FIG. 1A is a view along the longitudinal axis of a columnar heating device suitable for use in one embodiment of the present gaseous fluid generation system.

FIG. 1A illustrates an example of a columnar heating device suitable for use in the present gaseous fluid generation system. Columnar heating device 2 includes reservoir-less columnar vessel 4 having liquid fluid inlet 6; gaseous fluid outlet 8; ports 10, 12, and 14; and resistive heating elements 16, 18, and 20. Reservoir-less columnar vessel 4 can be made of any of a number of suitable materials known in the art such as stainless steel (e.g., SS304 or SS316). Reservoir-less columnar vessel 4 can be a cylindrical column as illustrated or can take other forms such as, for example, a rectangular column. In one embodiment, columnar vessel 4 is 3 inch stainless steel welded tubing with perpendicular, T-junction ports 10, 12, and 14 to accommodate electrical leads for resistive heating elements (e.g., resistive heating elements 16, 18, and 20).

Liquid fluid inlet 6 and gaseous fluid outlet 8 are located on the lowest and highest position of columnar vessel 4, respectively. The orientation of columnar vessel 4 should be such that the liquid fluid inlet 6 is at the lowest position of the vessel and the gaseous fluid outlet 8 is at the highest position. In one embodiment, columnar vessel 4 can be mounted on at least a slight incline to provide that the generated gaseous fluid can exit the vessel, as gas build up in the column could contribute to the failure of the resistive heating elements. As illustrated in FIG. 1A, liquid fluid inlet 6 and gaseous fluid outlet 8 are located at the ends of columnar vessel 4. In an alternative embodiment, one or both of liquid fluid inlet 6 and gaseous fluid outlet 8 can be located on a side of columnar vessel 4 so that liquid fluid can enter from the side and/or gaseous fluid can exit from the vessel to the side. In addition, in some embodiments, columnar vessel 4 can contain more than one liquid fluid inlet and/or more than one gaseous fluid outlet 8.

Ports, e.g., ports 10, 12, and 14, can be located in other positions than those shown in FIG. 1A. In FIG. 1A the ports, e.g., branch or perpendicular ports, are shown located in T-junctions of columnar vessel 4, but in some embodiments columnar vessel 4 does not contain T-junctions, for example, ports may be located directly on walls of the columnar vessel. In other embodiments, the columnar vessel does not contain dedicated ports to accommodate electrical leads for resistive heating elements. For example, electrical leads to resistive heating elements can be accommodated within or near the liquid fluid inlet and/or the gaseous fluid outlet. In the illustrated embodiment, columnar vessel 4 contains ports 10, 12, and 14 to accommodate electrical leads for three resistive heating elements 16, 18, and 20. In alternative embodiments not illustrated, the columnar vessel can contain fewer or more than three ports to accommodate fewer or more than three resistive heating elements.

Although three resistive heating elements are shown in FIG. 1A, the present gaseous fluid generation system can have as few as one resistive heating element and as many resistive heating elements as desired to convert the liquid fluid for the particular process or application flow rate and quality requirements (e.g., steam quality requirements).

Resistive heating elements suitable for use in the present invention include, but are not limited to, tubular heating elements. Tubular heating elements are generally constructed of resistance wire that is surrounded by an electrical insulator (e.g., ceramic) that is in turn surrounded by a metal covering (e.g., metal tube). Tubular heating elements can include single and double ended designs wherein the electrical circuit is exposed at a single end or at both ends to accommodate circuit powering. A single ended resistance tubular element can be used, for example, to accommodate fewer protrusions into the columnar vessel by providing a singular termination point.

Tubular heating elements suitable for use in the present invention can include, but are not limited to, u-shaped or hairpin elements, element coils with central return legs, or annular elements positionable in the center of the columnar vessel. Examples of suitable tubular heating elements are described in U.S. Pat. No. 6,456,785, issued to Evans on Sep. 24, 2002, the entire contents of which are incorporated herein in its entirety. One example of a suitable resistive heating element is a 4 kilowatt (kW), 240 volt (V), single phase element, Model No. CRES-24-12-SG-REP, commercially available from Infinity Fluids, Corp. (Norwich, Conn.).

In one embodiment, the gaseous fluid generation system includes at least one resistive heating element having a power density selected to heat a fluid selected from the group consisting of a liquid fluid, a saturated gaseous fluid and a superheated gaseous fluid. In one particular embodiment, resistive heating elements of the columnar vessel have a power density selected to heat both a liquid fluid and a gaseous fluid. For example, the resistive heating elements are of sufficiently low power density to ensure the stability of the elements under dry and semi-dry full output operating conditions.

As described above, systems of the present invention can have more than one resistive heating element. The resistive heating elements can be of the same or different power capacities. For example, as illustrated in FIG. 1A, resistive heating elements 16, 18, and 20 can be all similar electrically scheduled units, e.g., scheduled for 4 kW at 240 V, and of sufficiently low enough power density to ensure the stability of the element under dry and semi-dry full output operating conditions.

Referring again to the embodiment of the invention illustrated in FIG. 1A, resistive heating elements 16, 18, and 20 are shown attached through ports 10, 12, and 14. Fittings 22, 24, and 26 provide a secure connection to columnar vessel 4. Electrical leads 28, 30, and 32 are used to connect resistive heating elements to a power controller (not illustrated).

FIG. 1B illustrates a view along line 2—2 of the columnar heating device illustrated in FIG. 1A. Additional fitting 34 and additional electrical lead 36, obscured from view in FIG. 1A, are shown in FIG. 1B.

Figure 2:
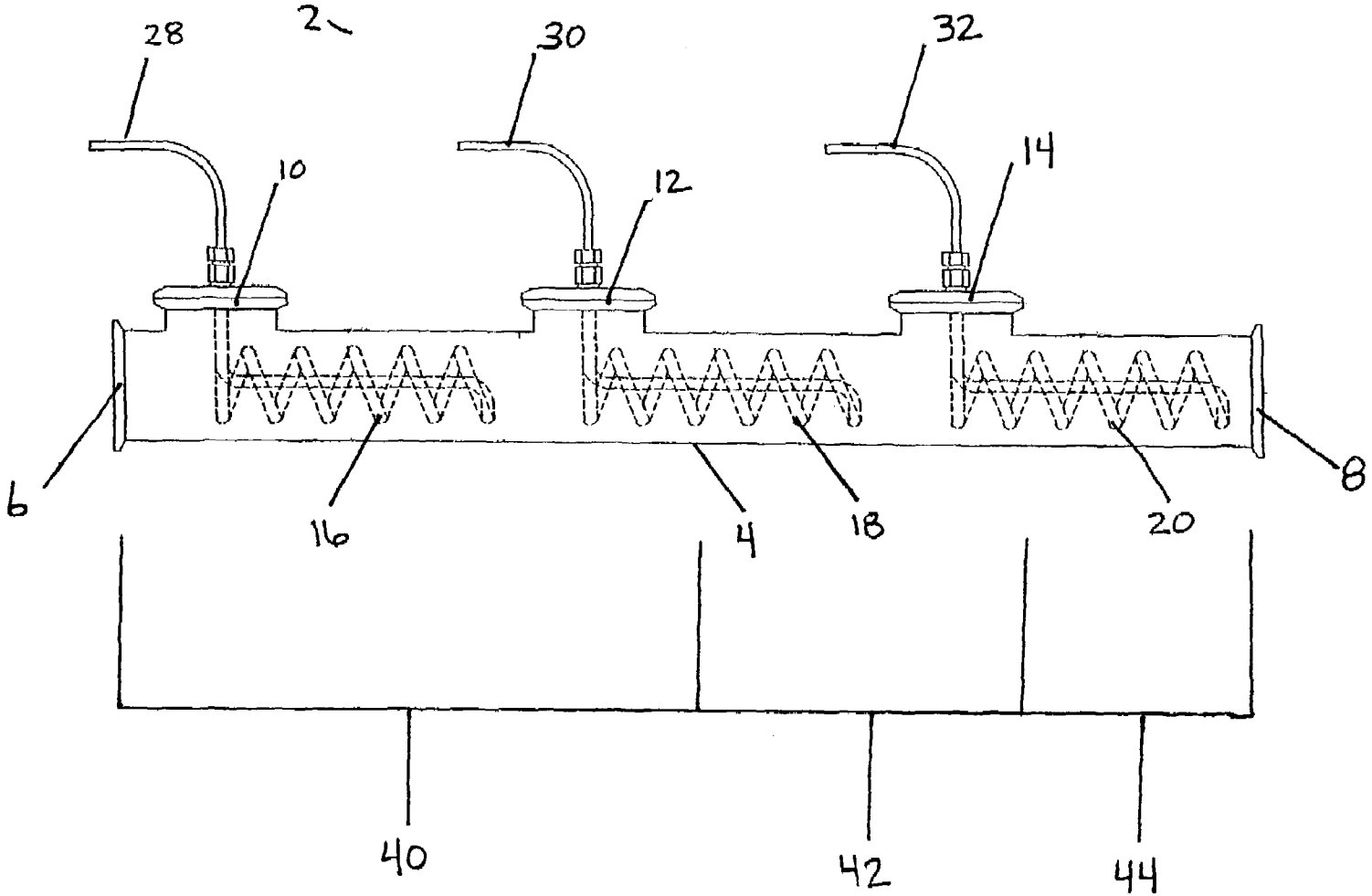
FIG. 2 is a view along the longitudinal axis of a columnar heating device illustrated in FIG. 1A showing regions of liquid fluid and gaseous fluids during operation of one embodiment of the present gaseous fluid generation system.

FIG. 2 is a view along the longitudinal axis of a columnar heating device illustrated in FIG. 1A showing regions of liquid fluid and gaseous fluids during operation of one embodiment of the present gaseous fluid generation system.

During operation of columnar heating device 2, liquid fluid (e.g., ambient temperature water) enters columnar vessel 4 at liquid fluid inlet 6, encounters resistive heating element 16 whereby energy is transferred to the liquid fluid. The fluid (e.g., a gas or liquid fluid) ascends columnar vessel 4 from resistive heating element 16 and encounters resistive heating element 18 whereby further energy is transferred to the fluid. For example, in one embodiment, the fluid encountering resistive heating element 18 is a liquid fluid and further energy from resistive heating element 18 is transferred to the liquid fluid, thereby beginning conversion of the liquid fluid to a saturated gaseous fluid. The fluid continues to ascend columnar vessel 4 and encounters resistive heating element 20 whereby yet more energy is transferred to the fluid. For example, in one embodiment, as the fluid ascends within columnar vessel 4 liquid bonds within the fluid can be broken down and the liquid fluid can become gaseous, e.g., transitioning from saturated steam.

As illustrated in FIG. 2, liquid fluid can be present in column region 40, saturated gaseous fluid can be present in column region 42, and superheated gaseous fluid can be present in column region 44. The boundaries between column regions 40, 42, and 44 are for illustrative purposes; FIG. 2 is not necessarily to scale. Boundaries between column regions can vary, for example, depending on process conditions. In one embodiment, liquid fluid can be present in a lower column region and saturated gaseous fluid can be present in an upper column region. For example, in one embodiment, little or no superheated gaseous fluid can be present.

As described, during operation, liquid fluid enters columnar vessel 4 through liquid fluid inlet 6. The liquid fluid can be forced up the column from positive pressure generated by a pressurized liquid fluid supply, such as provided by a pump or gravity. The liquid fluid occupies column region 40 enveloping one or more resistance heating resistive elements (e.g., as illustrated, resistive heating element 16 and a portion of resistive heating element 18). The water can be heated past its ambient pressure boiling point within column region 40, at which time it can begin to produce expansive pressure due to its liquid bonds separating. In column region 42, the liquid fluid is converted to a saturated gaseous fluid/liquid fluid mixture. The saturated mixture will transition through its saturated gaseous fluid phase until it reaches the top of column region 42, where it can be converted to a superheated gaseous fluid and continue to gain both temperature and pressure through column region 44.

It is important to note that in order to generate superheated gaseous fluid, the liquid fluid bonds are separated and this can be monitored through measurements of pressure and temperature at gaseous fluid outlet 8. If the temperature is elevated past the saturated gaseous fluid threshold and the pressure is low enough to ensure the increased pressurized atmosphere is not sufficient to re-collapse the gaseous fluid molecules, then the gaseous fluid is likely within its superheated phase. Without wishing to be held to any particular theory, the latent heat of vaporization is thought to consume a significant portion of the energy generated by the columnar heating device in generating a superheated gaseous fluid. This is thought to be one reason why the resistive heating elements are preferably selected to be of sufficiently low power density to ensure the heating elements can operate in all phases of the fluid being heated without detriment to their full output operation.

Proper orientation of columnar vessel 4, as described supra, and having the liquid fluid enter through the bottom of the vessel can provide that during operation the lowest temperatures are at the bottom of columnar vessel 4 (near liquid fluid inlet 6) and the highest temperatures are at the top of the vessel (near gaseous fluid outlet 8). Proper orientation of columnar vessel 4 can accommodate the natural tendency of gaseous fluid to rise and escape at the top of the vessel whereas any liquid fluid will likely tend to fall back to the head of the liquid fluid flow moving through the vessel.

Columnar vessel 4 can operate with at least two phases of the fluid apparent during normal operation, e.g., liquid fluid and gaseous fluid. In some embodiments, three phases of the fluid are apparent during normal operation, e.g., liquid fluid, saturated gaseous fluid and superheated gaseous fluid. Thus, the present invention provides for practical and instantaneous application of gaseous fluids in many processes including sterilization, process heating, fuel cells, steam cleaning and other applications where saturated gaseous fluid (e.g., saturated steam) and/or superheated gaseous fluid (e.g., superheated steam) are needed or desired.

Figure 3:
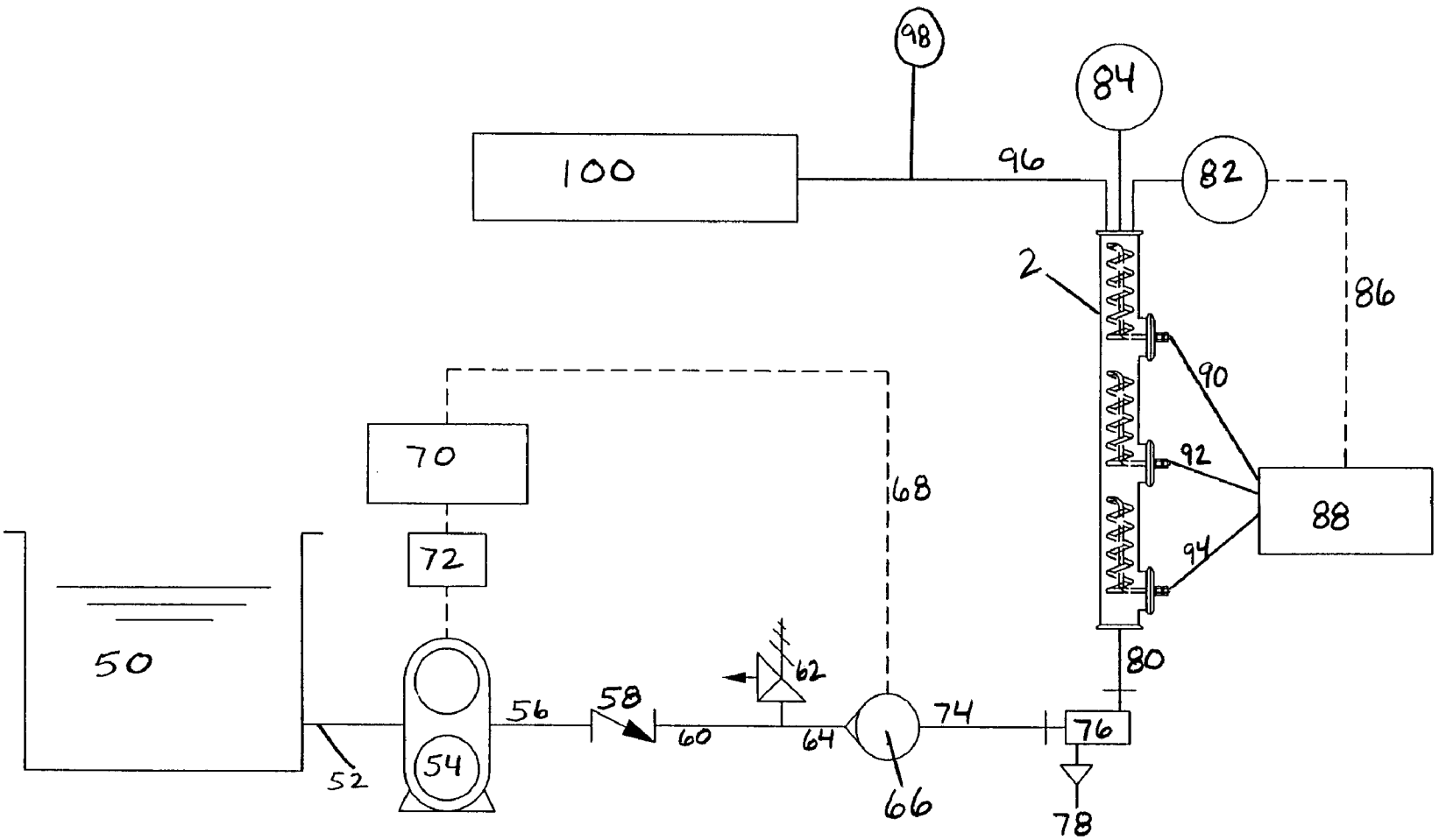
FIG. 3 is a schematic diagram of one embodiment of a gaseous fluid generation system in accordance with the present invention.

FIG. 3 illustrates one embodiment of the present gaseous fluid generation system. Liquid fluid can be provided by liquid source 50. Liquid source 50 can include a water source such as a local water reservoir, well or a municipal water supply. Alternatively, liquid source 50 can be an industrial process such as, for example, a filter operation or a chemical reactor or can be a holding tank or storage vessel.

In one embodiment, the gaseous fluid generation system further includes a pressurized liquid fluid supply. For example, the pressurized liquid fluid supply can be provided by municipally supplied water, a process feed, a gravity feed, or a pump. Suitable pumps include centrifugal, diaphragm, and rotary gear pumps, among others. As shown in FIG. 3, liquid fluid of liquid source 50 can moved through process lines 52 and 56 by pump 54 (e.g., a rotary gear pump). While there are many different means for pumping or inducing flow through columnar heating device 2, rotary gear pumps can be quite effective due to the stable, non-pulsing motion that they can provide, ensuring static flow during pressurized operations.

Pump 54 can produce both the flow and the flow-inducing pressure to move a stable volume of liquid fluid at the varying pressures which will be evident in the process as it initiates from a cold start condition, then through the boiling point and saturated gaseous fluid into the superheated phase, until pressure stabilizes along with flow and temperature. Check valve 58 can be used to prevent damage to the pump in the event of over-pressurization of the system. Following check valve 58, the liquid fluid flows through process lines 60 and 64. Pressure relief valve 62 can be positioned to accommodate over pressure on the supply side of columnar heating device 2. Flow meter 66 can be used following pressure relief valve 62 to measure volumetric flow rate of the liquid fluid during operation of the system. Flow meter 66 can be used to meter flow variations evident during start-up and to transmit proportional signal 68 back to process controller 70. Process controller 70 can accept signal 68 and maintain a stable input signal from flow meter 66 by means of a compensating signal or an output signal to variable pump drive 72 (e.g., a variable frequency drive). Variable pump drive 72 can accept the compensating signal or output signal from process controller 70 and transduce the input signal into a proportional frequency output to the motor which drives pump 54. In one embodiment, a stable flow of liquid fluid is provided by a pressurized liquid supply system that includes a rotary gear pump controlled by an electric motor receiving a frequency power signal from a variable frequency drive (VFD) or silicone carbide rectifier. For example, the VFD can have an input control signal, typically supplied by a process controller with an input from a flow meter (e.g., flow meter 66) either in pulse form or similar analog or digital output.

During operation of the present invention, when liquid fluid is introduced to the bottom of columnar heating device 2, it ascends the columnar vessel and gains energy in the form of heat. Once the liquid fluid gains enough heat, it reaches its boiling point at which time the liquid fluid (e.g., water) can begin to expand, generating pressure inside the columnar vessel. This pressure in the form of expanded liquid fluid creates a resistive pressure which pump 54 can pump against.

Absent pressure control, the volume flow of liquid fluid can begin to degrade due to the increased forces acting against it in the columnar heating device. A control loop flow indicator can provide empirical information for a process controller to evaluate and compensate for this by requesting that a variable drive increase pump operation. This process can compensate for the back pressure (e.g., in the form of increased cyclical operation at the gear head using a rotary gear pump) ensuring that the speed of the pump increases with regard to the actual flow rate, which becomes a dynamic variable once the columnar heating device reaches pressure.

As shown in FIG. 3, liquid fluid is pumped through process line 74 to optional junction 76 and optional drain 78. Liquid fluid then flows through process line 80 and is fed to columnar heating device 2. Suitable examples of columnar heating device 2 are shown in FIGS. 1A, 1B, and 2. Columnar heating device 2 accepts the incoming liquid fluid at it lowest point and within columnar heating device 2 gaseous fluid is produced as described supra.

As illustrated, thermocouple 82 can be positioned to measure temperature of the gaseous fluid as it exits columnar heating device 2. This can be, for example, an enclosed junction grounded thermocouple, e.g., chromel-alumel (Type K). Thermocouple 82 can provide output signal 86 to temperature and power controller 88. Temperature and power controller 88 can accept output signal 86 and provide line voltage(s) to power lines 90, 92, and 94 that connect to electrical leads of the resistive heater elements (e.g., electrical leads 28, 30, and 32 of FIG. 1A) contained in columnar heater system in accordance with output signal 86. Temperature and power controller 88 can include, for example, a process temperature controller (PTC) and a power controller, e.g., a silicone carbide rectifier power control system. In one embodiment, the power controller is phase angle fired for accurate and accommodating output to the resistive heating elements of columnar heating device 2. In one embodiment, the power controller can accept a compensating output signal from the PTC and proportion the line voltage(s) in accordance with its input signal. Thus, a closed loop control can be used to control the line voltage fed to columnar heating device 2 and can be used to compensate for varying flows, inlet temperatures and ambient conditions. In one embodiment, the same line voltage is fed to each resistive heating element of the columnar heating device 2. In other embodiments, the line voltages may differ.

Also as illustrated in FIG. 3, pressure gauge 84 can be positioned to measure pressure of the gaseous fluid at the gaseous fluid outlet of columnar heating device 2. Gaseous fluid exits columnar heating device 2 via process line 96. In one embodiment, the present system further contains a coupling, e.g., process line 96 illustrated in FIG. 3, providing fluid communication between the gaseous fluid outlet of columnar heating device 2 and application 100 requiring a gaseous fluid.

Optionally, temperature of the gaseous fluid product can be measured, for example, via second thermocouple 98. The gaseous fluid then flows to application 100 where the gaseous fluid product is utilized or consumed. The gaseous fluid generation system of the present invention can be used, for example, for cleaning, sterilizing, heating industrial systems, humidification, steam purge processes, and many process systems, heating and pre-heating fuel cell systems, contaminant removal and all processes which require saturated steam and super heated gaseous fluid as a carrier or catalyst.

For most process requirements, the columnar heating devices described herein can support a uniform pressure condition as to permit one columnar vessel to operate with three separate phases of a fluid sharing the same chamber. To accommodate more dynamic applications, more than one columnar heating device can be mechanically inline with one another (e.g., independent systems can be stacked). In another embodiment, restrictor orifices can be placed between resistive heating elements to create separate chambers within a columnar vessel. In some embodiments, stacking independent systems or placing restrictor orifices can be used to take advantage of the expansion effects associated with a differential pressure throttle valve.

Gaseous fluid generation systems described herein also can employ various control systems, pressure relief valves, over temperature switches, flow monitoring devices, pressure gauge and monitors, and others devices and techniques known to those of ordinary skill in the art.

The present invention also includes a method for generating a gaseous fluid that uses the gaseous fluid generation system described herein. The present invention includes a method for generating a gaseous fluid that includes the steps of: (a) directing a liquid fluid into a reservoir-less columnar vessel having a liquid fluid inlet and a gaseous fluid outlet and oriented such that the gaseous fluid outlet is elevated with respect to the liquid fluid inlet and also having at least one resistive heating element contained within the columnar vessel; and (b) transferring energy provided through the resistive heating element to the liquid fluid to effect a phase transition, thereby producing a gaseous fluid from the liquid fluid prior to exiting the columnar vessel. In one embodiment, the method further includes the step of reacting one or more components of the liquid fluid or gaseous fluid within the columnar vessel.

EXEMPLIFICATION

The present invention will now be further and specifically described by the following example, which is not intended to be limiting.

The following example describes operation of a gaseous fluid generation system produced in accordance with the present invention. A gaseous fluid generation system was assembled substantially as depicted in FIG. 3, but without automatic flow control (components 68–72). The components listed in Table 1 were used.

TABLE 1

System Components

| Component (references to FIG. 3) | Supplier/Model |
|---|---|
| columnar heating device 2 | Infinity Fluids, Corp., Model No. CRES-24-12-SG Inline Steam Generator (12 kW, 240 V) 3 inch diameter, 30 inch long stainless steel vessel equipped with CRES-24-12-SG-REP tubular heating elements (each 4 kW, 240 V, single phase) |
| pump 54 | LiquiFlo Pump Model No. H3FS6P3EU02000 equipped with a Baldor CDP3320 ⅓ horsepower motor and a KBIC-240D motor drive |
| pressure relief valve 62 | Swagelok PRV 100 psi Model No. SS-4R3A1 |

TABLE 1-continued

System Components

| Component (references to FIG. 3) | Supplier/Model |
|---|---|
| flow meter 66 | Orange Research Model No. 2021-FGS-1A-2.51-A |
| thermocouple 82 | Type K chromel-alumel, junction armored, compression fitted |
| pressure gauge 84 | Wika Model No. 9744940-829 |
| temperature and power controller 88 | Avatar, Model No. A3P-240-100 and Cal 3200 standard temperature controller |

Table 2 shows process conditions resulting from use of this system using a water feed. Pressure was manually adjusted to maintain a constant volumetric flow rate of fed water. Table 2 demonstrates that the system and method of the present invention can be used to produce superheated gaseous fluids.

TABLE 2

Process Conditions

| Time (min) | Columnar Vessel Temperature (° F.) | Steam Temperature at 1 atm (° F.) | Flow Rate (gal/hr) | Columnar Vessel Pressure (psi) |
|---|---|---|---|---|
| 1 | 148 | 100 | 4 | 0 |
| 2 | 215 | 175 | 4 | 0 |
| 3 | 253 | 214 | 4 | 28 |
| 4 | 271 | 216 | 4 | 30 |
| 5 | 265 | 216 | 4 | 25 |
| 6 | 260 | 215 | 4 | 24 |
| 7 | 258 | 215 | 4 | 22 |
| 8 | 258 | 215 | 4 | 22 |
| 9 | 258 | 216 | 4 | 22 |
| 10 | 258 | 216 | 4 | 22 |

While this invention has been particularly shown and described with references erred embodiments thereof, it will be understood by those skilled in the art that changes in form and details may be made therein without departing from the of the invention encompassed by the appended claims.

I claim:

1. A gaseous fluid generation system, comprising:

a) a reservoir-less columnar vessel having a liquid fluid inlet and a gaseous fluid outlet, oriented such that the gaseous fluid outlet is elevated with respect to the liquid fluid inlet; and b) at least one resistive heating element contained within the columnar vessel, and wherein the pressure of the liquid fluid entering the columnar vessel is varied such that a constant volumetric flow of the liquid fluid into the vessel is maintained.

2. The gaseous fluid generation system of claim 1 further comprising a pressurized liquid fluid supply.

3. The gaseous fluid generation system of claim 2 wherein the pressurized liquid fluid supply is provided by a pump.

4. The gaseous fluid generation system of claim 1 having at least three resistive heating elements contained within the columnar vessel.

5. The gaseous fluid generation system of claim 1 wherein the resistive heating element is a tubular heating element.

6. The gaseous fluid generation system of claim 1 wherein the resistive heating element has a power density selected to heat a fluid selected from the group consisting of a liquid fluid, a saturated gaseous fluid and a superheated gaseous fluid.

7. The gaseous fluid generation system of claim 1 wherein the resistive heating element has a power density selected to heat a liquid fluid and a gaseous fluid.

8. The gaseous fluid generation system of claim 1 further containing a coupling providing fluid communication between the gaseous fluid outlet and an application requiring a gaseous fluid.

9. A method for generating a gaseous fluid, comprising the steps of:

a) directing a liquid fluid into a reservoir-less columnar vessel having a liquid fluid inlet and a gaseous fluid outlet and oriented such that the gaseous fluid outlet is elevated with respect to the liquid fluid inlet and also having at least one metal-covered resistive heating element contained within the columnar vessel; and b) transferring energy provided through the resistive heating element to the liquid fluid to effect a phase transition, thereby producing a gaseous fluid from the liquid fluid prior to exiting the columnar vessel, and wherein the pressure of the liquid fluid entering the columnar vessel is varied such that a constant volumetric flow of the liquid fluid into the vessel is maintained.

10. The method of claim 9 wherein the liquid fluid is an aqueous solution.

11. The method of claim 9 wherein the liquid fluid is a slurry.

12. The method of claim 9 wherein the gaseous fluid is steam.

13. The method of claim 9 wherein the gaseous fluid is superheated vapor.

14. The method of claim 9 wherein the gaseous fluid is saturated vapor.

15. The method of claim 9 further comprising the step of reacting one or more components of the liquid fluid or gaseous fluid within the columnar vessel.

16. The method of claim 9 further comprising the step of directing the gaseous fluid to an application selected from the group consisting of heating, cleaning, sterilization and humidification.

17. A columnar heating device, comprising:

a) a reservoir-less columnar vessel having a liquid fluid inlet and a gaseous fluid outlet; and b) at least one metal-covered resistive heating element contained within the columnar vessel, wherein the resistive heating element has a power density selected to heat a liquid fluid and a gaseous fluid, and wherein the pressure of the liquid fluid entering the columnar vessel is varied such that a constant volumetric flow of the liquid fluid into the vessel is maintained.

18. The gaseous fluid generation system of claim 1 further comprising a pressure control system whereby flow of a liquid fluid feed is regulated.

19. The gaseous fluid generation system of claim 1 further comprising a closed loop power control system whereby power fed to the columnar device is varied to compensate for at least one condition selected from the group consisting of liquid fluid flow, liquid fluid inlet temperature, outlet gaseous fluid temperature, ambient temperature, and ambient pressure.

20. The method of claim 9 wherein a liquid fluid, a saturated gaseous fluid and a superheated gaseous fluid are contemporaneously present in the columnar vessel.

21. The method of claim 9 wherein a first portion of the resistive heating element is operated in the liquid fluid and a second portion of the resistive heating element is operated in the gaseous fluid.

22. The columnar heating device of claim 17 wherein the columnar vessel is metal.

23. The columnar heating device of claim 17 wherein the resistive heating element is stable under full output operating conditions when the element is only partially immersed in a liquid fluid.

24. The gaseous fluid generation system of claim 1 wherein liquid fluid continually enters the columnar vessel and is continually heated and wherein a phase transition is continuously induced to produce a continuous flow of gaseous fluid from said vessel.

25. The method of claim 9 wherein liquid fluid continually enters the columnar vessel and is continually heated and wherein a phase transition is continuously induced to produce a continuous flow of gaseous fluid from said vessel.

26. The columnar heating device of claim 17 wherein liquid fluid continually enters the columnar vessel and is continually heated and wherein a phase transition is continuously induced to produce a continuous flow of gaseous fluid from said vessel.

* * * * *